United States Patent [19]

Aoshiba

[11] 4,204,794

[45] May 27, 1980

[54] APPARATUS FOR ATTACHING IMPLEMENT TO EARTH MOVING VEHICLE

[75] Inventor: Norihiro Aoshiba, Komatsu, Japan

[73] Assignee: Kabushiki Kaisha Komatsu Seisakusho, Tokyo, Japan

[21] Appl. No.: 816,706

[22] Filed: Jul. 18, 1977

[51] Int. Cl.[2] ..... E02F 3/81

[52] U.S. Cl. ..... 414/723; 172/272

[58] Field of Search ..... 214/145 R, 145 A; 172/272, 273; 37/117.5, 118 R, 118 A; 280/456 A, 460 A, 461 A; 414/723

[56] References Cited

U.S. PATENT DOCUMENTS

| | | | |
|---|---|---|---|
| 3,512,665 | 5/1970 | Westendorf | 214/145 A |
| 3,760,883 | 9/1973 | Birk | 172/273 |
| 3,935,953 | 2/1976 | Stedman | 214/145 A |
| 4,013,182 | 3/1977 | Pratt et al. | 214/145 A |
| 4,116,347 | 9/1978 | Uchida | 214/145 A |

FOREIGN PATENT DOCUMENTS

| | | | |
|---|---|---|---|
| 1431698 | 1/1969 | Fed. Rep. of Germany | 214/145 A |
| 1457680 | 5/1969 | Fed. Rep. of Germany | 172/272 |

*Primary Examiner*—L. J. Paperner

*Attorney, Agent, or Firm*—Armstrong, Nikaido, Marmelstein & Kubovcik

[57] ABSTRACT

An apparatus for attaching an implement to an earth moving vehicle, comprising a pair of lift arms for lifting the implement, a pair of tilt rods for effecting tilting motion of the implement, a pair of lower couplers pivotally connected to said lift arms at one end thereof, and a pair of upper couplers pivotally connected to said pair of tilt rods, the upper and lower couplers being pivotally connected with each other. The pair of lower couplers and pair of upper couplers are transversely connected by connecting beams, respectively. The connecting beams are adapted to engage with C-shaped hooks fixedly secured to the rear surface of the implement.

6 Claims, 17 Drawing Figures

FIG. 12-I
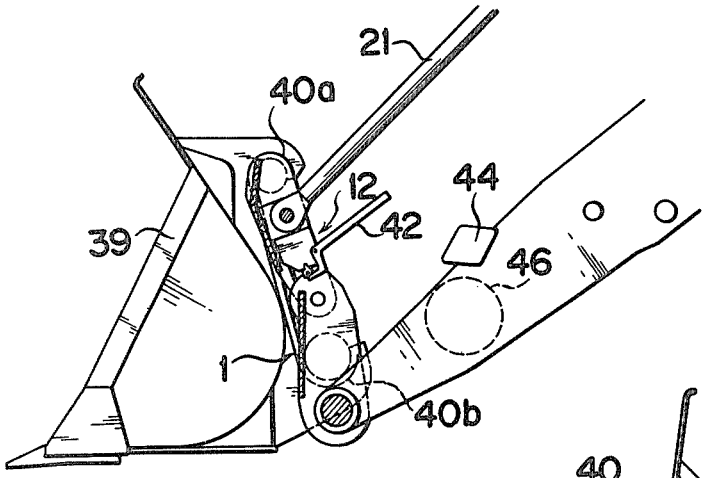
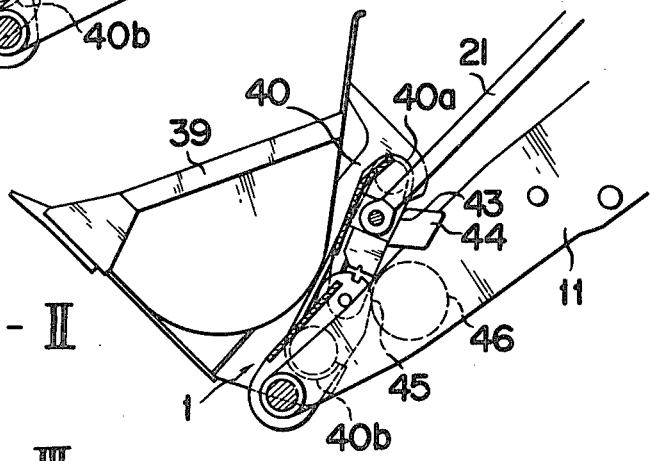
FIG. 12-II
FIG. 12-III
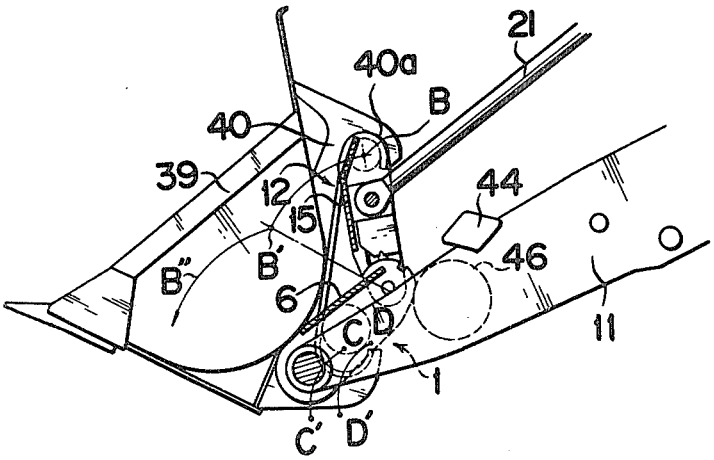

FIG. 12-IV
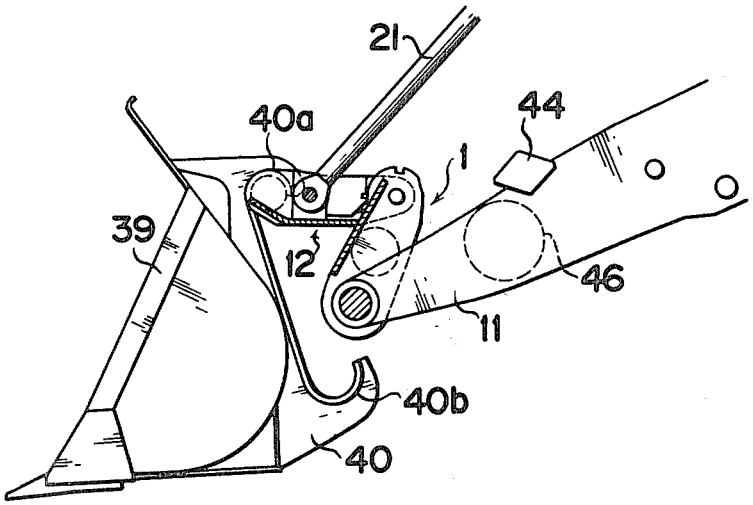
FIG. 12-V
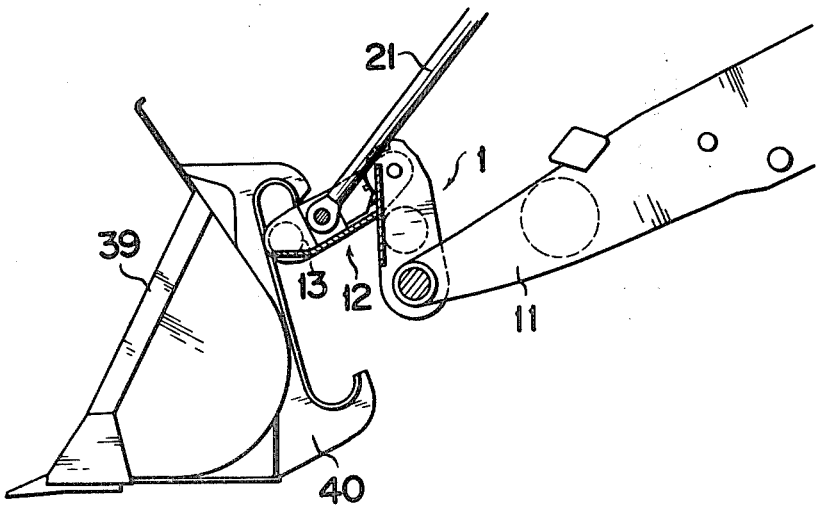

APPARATUS FOR ATTACHING IMPLEMENT TO EARTH MOVING VEHICLE

BACKGROUND OF THE INVENTION

This invention relates to an apparatus for attaching implements to earth moving vehicles.

Heretofore attaching an implement to or replacing it from an earth moving vehicle required complicated and time consuming procedures. For example, when it is required to replace an implement from the vehicle, it is generally necessary to move the implement by means of a crane, etc. in order to align pin holes of the implement with those of lift arms of the vehicle. After aligning pin holes, pins are inserted therethrough so as to attach the implement to the vehicle. It is difficult to align pin holes formed in the implement and the lift arms of the vehicle by moving the vehicle itself without moving the implement by the crane or the like.

SUMMARY OF THE INVENTION

It is, therefore, an object of the present invention to provide an apparatus for attaching implements to an earth moving vehicle wherein replacement of the implements can be carried out easily.

Another object of the present invention is to provide an apparatus for attaching implements to an earth moving vehicle wherein replacement of the implements can be carried out from the driver's cab.

According to one aspect of the present invention, there is provided an apparatus for attaching implements to an earth moving vehicle, comprising a pair of lift arms for lifting the implement, a pair of tilt rods for effecting tilting motion of the implement, a pair of lower couplers pivotally connected to said lift arms at one end thereof, and a pair of upper couplers pivotally connected to said pair of tilt rods. Said upper couplers are pivotally connected with said lower couplers. A pair of connecting beams are provided so as to interconnect said pair of lower couplers and said pair of upper couplers, respectively. Said connecting beams are adapted to engage with C-shaped hooks fixedly secured to the rear surface of the implement.

Lock means is provided either on said upper couplers or said lower couplers so as to block pivotal movement of said upper couplers relative to said lower couplers when said couplers are engaged with the hooks of the implement.

Lock releasing means may be provided on said lift arms of the vehicle so as to release said lock means from the driver's cab when it becomes necessary.

Other objects, features and advantages of the present invention will be readily apparent from the following description taken in conjunction with the accompanying drawings.

BRIEF DESCRIPTION OF THE DRAWINGS

FIG. 12-I to FIG. 12-V are explanational views showing procedures for removing the implement from the vehicle according to the present invention;

DETAILED DESCRIPTION OF THE INVENTION

Figure 1:
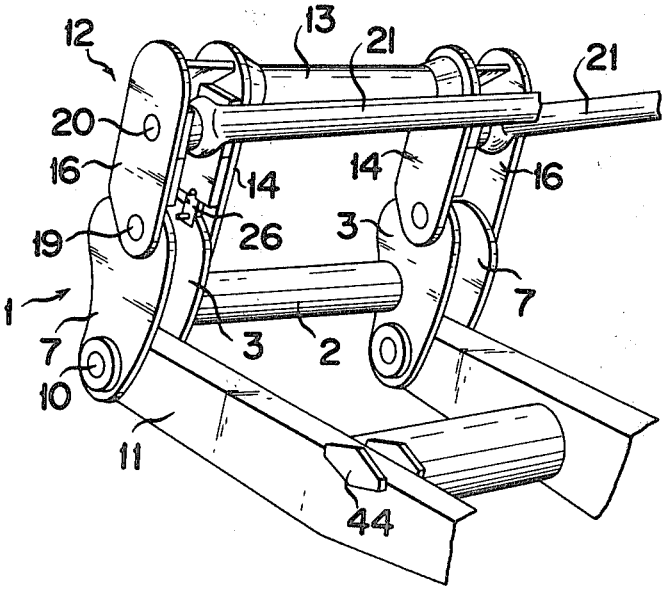
FIG. 1 is a perspective view of the present invention.
Figure 2:
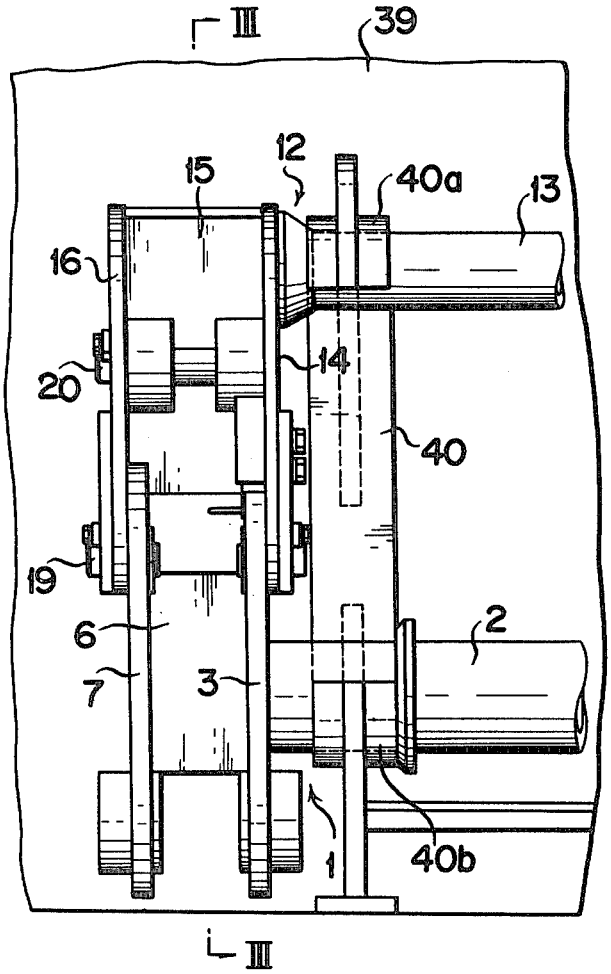
FIG. 2 is a partial back elevational view of FIG. 1.
Figure 3:
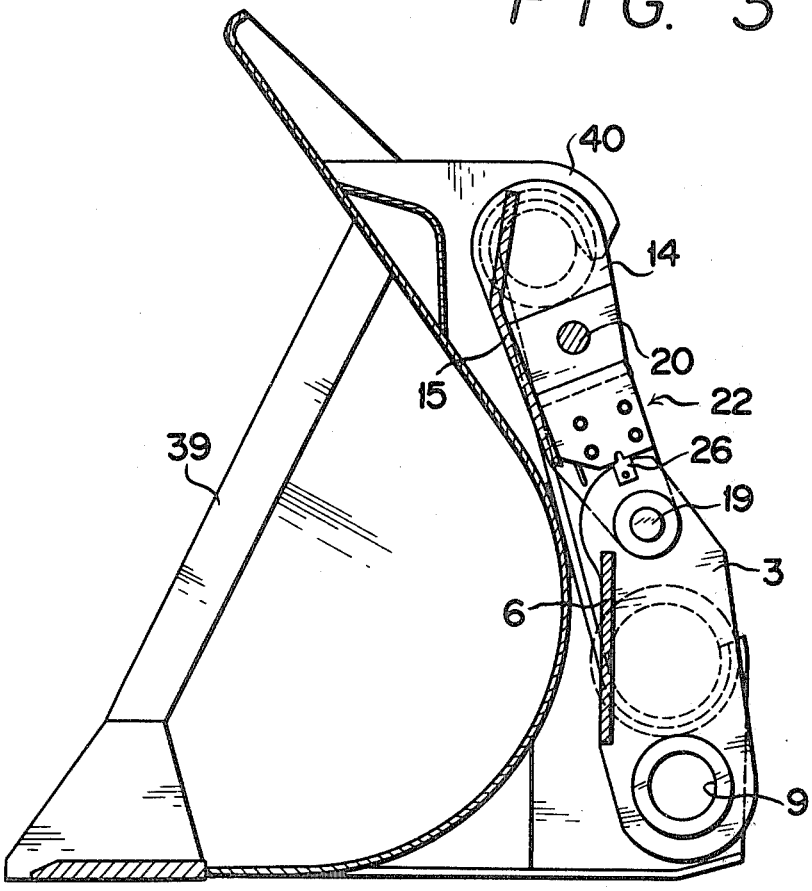
FIG. 3 is a cross-sectional view taken along the line III—III in FIG. 2.
Figure 4:
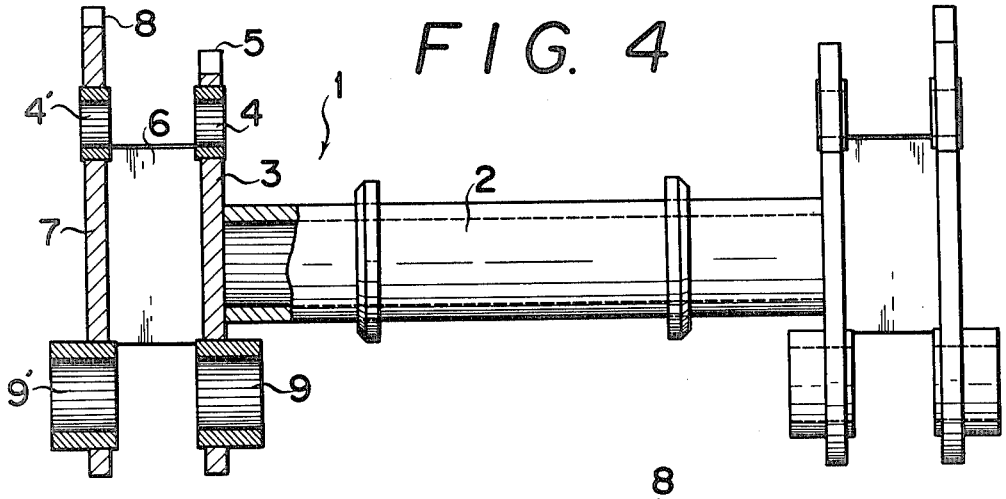
FIG. 4 is a front elevational view partially in cross-section of lower couplers according to the present invention.
Figure 5:
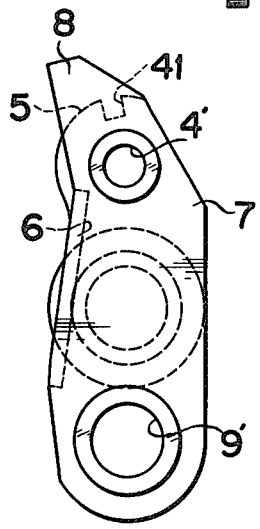
FIG. 5 is a side elevational view of FIG. 4.

The present invention will now be described in detail below with reference to drawings. Reference numeral 1 denotes a lower coupler having a beam 2. Fixedly secured to both ends of the beam 2 are inner plates 3. Referring to FIG. 4, each of the inner plate 3 has a pin hole 4 formed in the upper part thereof. Further, the upper edge of the inner plate is formed in a circular cam portion 5 defined about the pin hole 4. Each of the inner plate 3 is connected through a connecting plate 6 with an outer plate 7 disposed in parallel therewith. The outer plate 7 has a pin hole 4' formed in the upper part thereof. Further, the outer plate 7 has a stopper 8 formed in the upper edge portion thereof. The inner and outer plates 3 and 7 have pin holes 9 and 9' formed in the lower parts thereof, respectively.

Connected to the lower coupler 1 having pins 10 inserted into the pin holes 9 and 9' are a pair of lift arms 11 of a vehicle.

Figure 6:
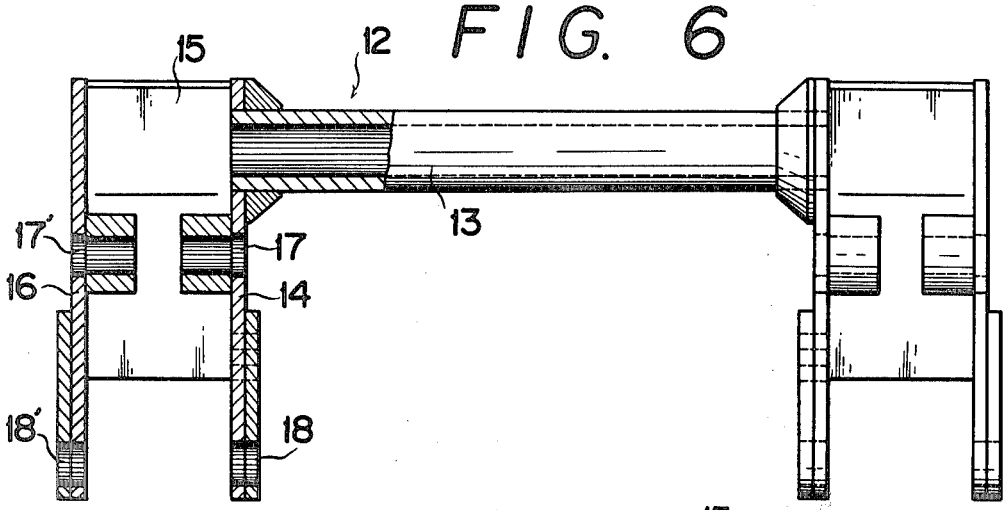
FIG. 6 is similar to FIG. 4 but showing upper couplers according to the present invention.
Figure 7:
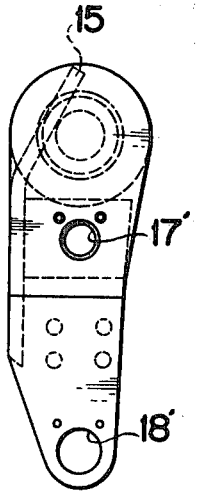
FIG. 7 is a side elevational view of FIG. 6.

Reference numeral 12 denotes an upper coupler having a beam 13. Fixedly secured to both ends of the beam 13 are inner plates 14. Each of the inner plate 14 is fixedly secured through a connecting plate 15 to an outer plate 16 disposed in parallel therewith. Further, each of the inner and outer plates 14 and 16 has pin holes 17, 17' and 18, 18' formed in the upper and lower parts thereof, respectively. (refer to FIG. 6).

The upper part of the lower coupler 1 is inserted into the lower part of the upper coupler 12. The upper and lower couplers 12 and 1 are interconnected by means of pins 19 each being inserted into the pin holes 18, 18', 9 and 9'. The stopper 8 is adapted to contact with the connecting plate 15 when the upper coupler 12 is aligned with the lower coupler 1.

Connected to the upper coupler 12 having pins 20 inserted into the pin holes 17 and 17' are tilt rods 21 of the vehicle.

Figure 8:
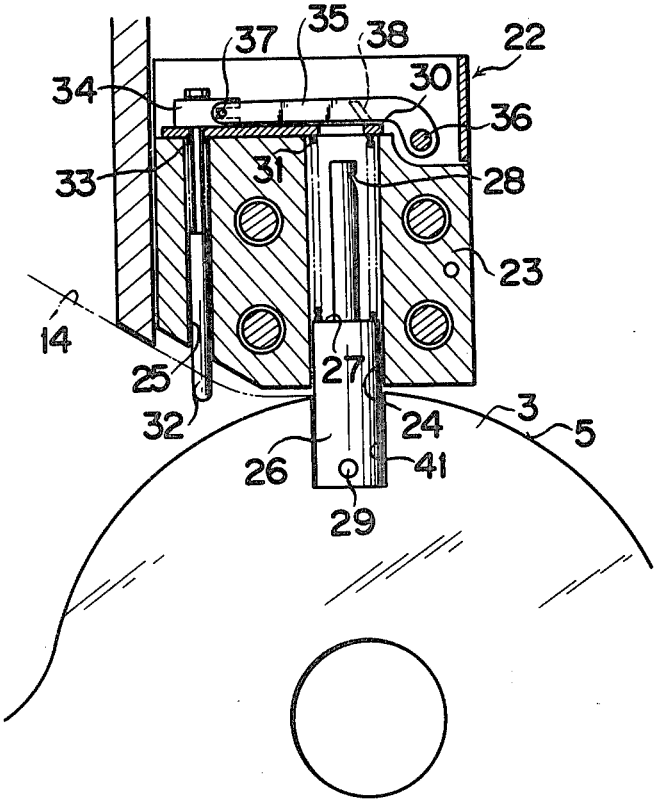
FIG. 8 is an enlarged cross-sectional view of lock means according to the present invention.
Figure 9:
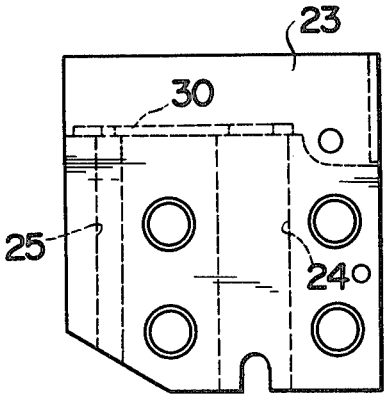
FIG. 9 is a front elevational view of FIG. 8.
Figure 10:
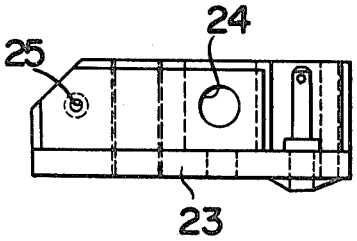
FIG. 10 is a plan view thereof.

Referring to FIG. 8, the inner plate 14 of the upper coupler 12 have a lock means 22 fixedly secured thereto. The lock means 22 comprises a block 23 fixedly secured to the inner plate 14. The block 23 has vertically extending holes 24 and 25 formed therein. Inserted into the hole 24 is a lock pin 26 having a spring seat 26 formed thereon. The lock pin 26 has a notch 28 formed in the upper end thereof, and also has a pin 29 attached to the lower part thereof. The block 23 has a spring retainer plate 30 fixedly secured thereto, and a spring 31 is interposed between the spring retainer plate 30 and the spring seat 27. Inserted into the hole 25 is a rod 32 urged downwardly by the biasing force of a spring 33. A yoke 34 is attached to the upper end of the rod 32.

The block 23 has in the upper part thereof a lever 35 pivotally mounted by means of a pin 36. The leading end of the lever 35 is connected through a pin 37 to the yoke 34. A claw 38 is fitted to the lever 35.

Figure 11:
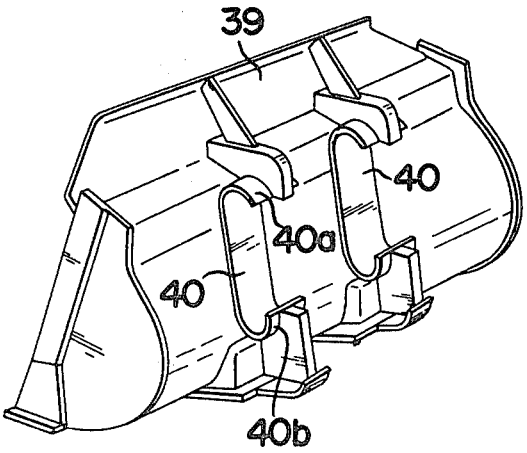
FIG. 11 is a perspective view of an implement according to the present invention.

In FIG. 11, reference numeral 39 denotes an implement comprising a bucket. The implement 39 has a pair of C-shaped hooks 40 fixedly secured to the rear surface thereof.

The implement 39 is fitted to the lift arms 11 by allowing the beam 13 of the upper coupler 12 to engage with upper portions 40*a* of the hooks 40 and the beam 2 of the lower coupler 1 to engage with the lower portions 40*b* of the hooks 40. In this case, the lock pin 26 of the lock means 22 is inserted into stopper grooves 41 of the circular cam parts 5 of the inner plates 3.

The operation of the apparatus of the present invention will now be described below.

The lock pin 26 is lifted by the operator against the biasing force of the spring 31 by pulling up a tool 42 engaged by him with the pin 29 of the lock pin 26 so that the notch 28 of the lock pin 26 can be engaged with the claw 38 of the lever 35 thereby disengaging the lock pin 26 from the stopper groove 41. (Refer to FIG. 12-I)

Then, the implement 39 is tilted back to allow the stopper face 43 of the upper coupler 12 to abut against the stopper 44 of the lift arms 11. Subsequently, the implement is dumped to allow stopper face 45 of the lower coupler 1 to abut against a connecting rod 46 of the lift arms 11. (refer to FIG. 12-II)

Thereafter, when the lift arms 11 are lifted and the implement 39 is dumped continuously further, the upper portions 40*a* of hooks 40 of implement 39 are engaged with the beam 13 of the upper coupler 12, whilst the beam 2 will move along the guide until the lower coupler 1 is allowed to abut against the implement 39. If the implement 39 is dumped continuously further, point "B" on the upper coupler 12 will move to point "B'"; point "C" on the implement 39 will move to point "C'"; and point "D" will move to point "D'" so that the upper and lower couplers 12 and 1 are kept at an angle of about seventy degrees by the connecting plates 6 and 15. (Refer to FIG. 12-III) At that time the rod 32 of the lock means 22 is allowed to abut against the circular cam portions 5 of the inner plates 3 thereby actuating the lever 35 so that the claw 38 can be disengaged from the notch 28 of the lock pin 26. As a result, the lock pin 26 is urged by the resilient force of the spring 31 against the abovementioned circular cam portions 5.

If the implement 39 is dumped further, the point "B" will move towards point "B'".

In the next place, the implement 39 is dumped further while it is placed on the ground and the vehicle is moved backwards. (Refer to FIG. 12-IV)

Next, dumping of the implement is stopped when the beam 13 has been disengaged from the hooks 40, and the vehicle is moved back further so as to detach the implement 39. (Refer to FIG. 12-V)

The implement 39 can be mounted on the vehicle by effecting the abovementioned sequence reversely.

In the above-mentioned embodiment of the present invention, unlocking of the lock means 22 is made manually; however another embodiment of the invention which will be mentioned below is of a type wherein the arrangement is made such that the lock means can be unlocked by the operator in the driver's cab effecting its remote controls.

Figure 13:
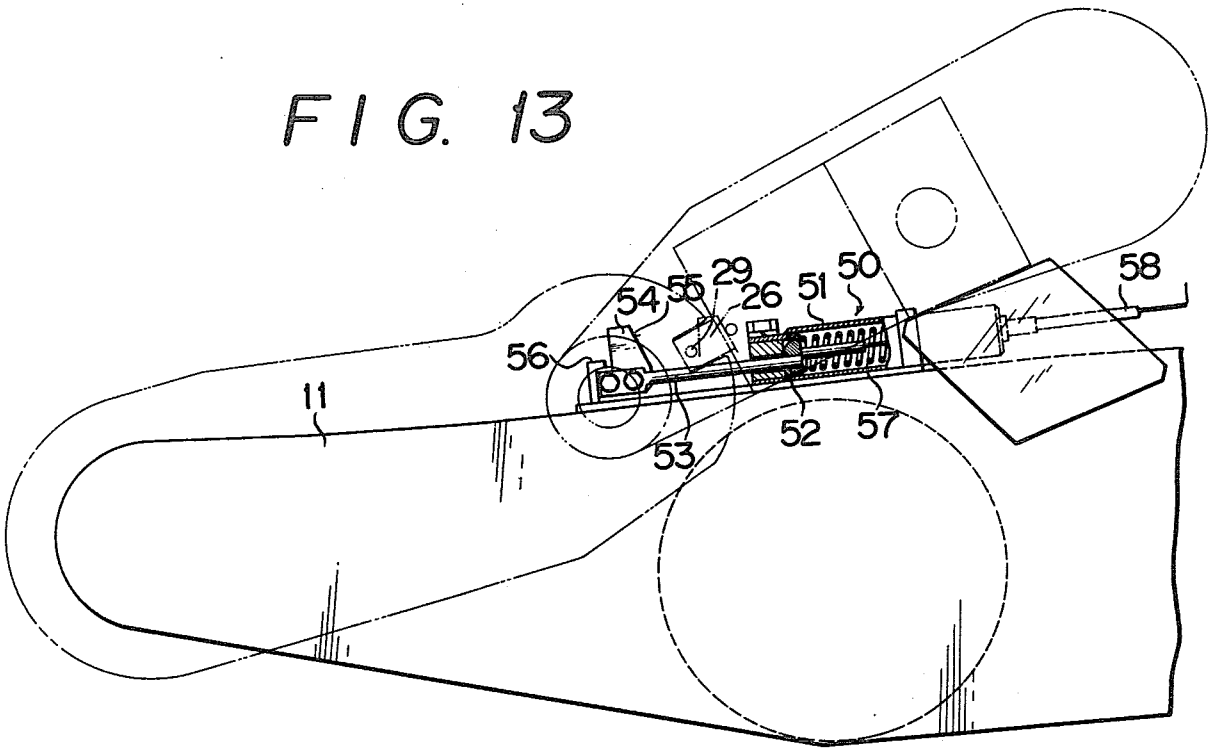
FIG. 13 is a side elevational view partially in cross-section of lock releasing means according to the present invention.
Figure 14:
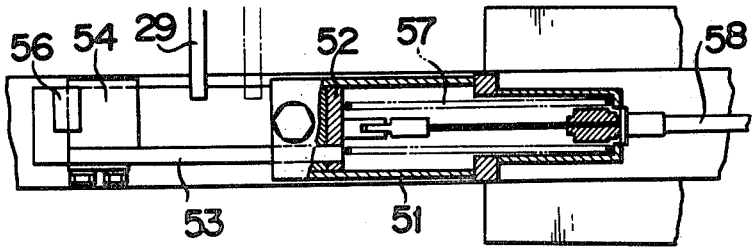
FIG. 14 is a plan view partially in cross-section of FIG. 13.

The aforementioned lift arms 11 have unlocking means 50 fixedly secured on the upper surfaces thereof. The unlocking means 50 comprises a spring loaded cylinder 51 fixedly mounted on the lift arm 11. Slidably mounted in the spring loaded cylinder 51 is a piston 52. The piston 52 has a rod 53 connected to a member 54 having an inclined face 55 formed thereon. Each of the lift arms 11 has a stopper 56 fixedly secured thereto. Accommodated within the spring loaded cylinder 51 is a spring 57 which urges the piston 52 thereby allowing the member 54 to urge against the stopper 56. The piston 52 is connected to a cable 58 which extends to the driver's cab so as to be connected to a control lever (refer to FIG. 13).

Thus, if the control lever is operated to pull the cable 58 to the right hand, the piston 52 is moved against the biasing force of the spring 57, the member 54 is moved through the rod 53 and the unlocking pin 29 is pushed upwardly by the inclined face 55 of the member 54, the lock pin 26 can be disengaged from the grooves 41, and the notch 28 of the lock pin 26 can be engaged with the claw 38 of the lever 35. In this condition, the upper and lower couplers 12 and 1 becomes capable of swinging freely relative to each other.

It is to be understood that the foregoing description is merely illustrative of the preferred embodiments of the present invention and that the scope of the present invention is not to be limited thereto, but is to be determined by the scope of the appended claims.

What is claimed is:

1. An apparatus for attaching an implement to an earth moving vehicle, said implement having a C-shaped hook formed on a rear surface thereof, the apparatus comprising:

a pair of lift arms for lifting the implement;

a pair of tilt rods for effecting tilting motion of the implement;

a pair of lower couplers pivotally connected to said lift arms at one end thereof;

a pair of upper couplers pivotally connected to said tilt rods, said lower and upper couplers being pivotally connected with each other;

an upper connecting beam provided between said pair of upper couplers for connecting said upper couplers;

a lower connecting beam provided between said pair of lower couplers for connecting said lower couplers, said upper and lower connecting beams being adapted to engage with the C-shaped hook formed on the rear surface of the implement; and lock means comprising a first means on one of said upper or lower couplers for engaging second means on the corresponding other of said upper or lower couplers, said locking means automatically locking said lower couplers relative to said upper couplers thereby preventing pivotal movement with each other when said upper and lower connecting beams are engaged in said C-shaped hooks while allowing pivotal movement of said lower couplers relative to said upper couplers, when in an unlocked state.

2. The apparatus as defined in claim 1 further comprising lock releasing means provided on said lift arms for releasing said lock means thereby allowing said couplers to pivot with each other.

3. An apparatus for attaching an implement to an earth moving vehicle as claimed in claim 1, wherein said first means includes locking elements retractably extending parallel to the plane of said upper and lower couplers and perpendicular to said upper and lower connecting beams.

4. An apparatus for attaching an implement to an earth moving vehicle, said implement having a C-shaped hook formed on the rear surface thereof, the apparatus comprising:

a pair of lift arms for lifting the implement;

a pair of tilt rods for effecting tilting motion of the implement;

a pair of lower couplers pivotally connected to said lift arms at one end thereof;

a pair of upper couplers pivotally connected to said tilt rods, said lower and upper couplers being pivotally connected with each other;

an upper connecting beam provided between said pair of upper couplers for connecting the same;

a lower connecting beam provided between said pair of lower couplers for connecting the same, said upper and lower connecting beams being adapted to engage with the C-shaped hook formed on the rear surface of the implement; and lock means for locking said lower couplers relative to said upper couplers thereby preventing pivotal movement with each other, said lock means comprising a block having a hole formed therein, said block being fixedly secured to said upper couplers, a lock pin slidably inserted in the hole of said block, and spring means disposed in the hole as to urge said lock pin towards said lower couplers thereby engaging said lock pin with a hole formed at the upper portion of said lower couplers.

5. An apparatus for attaching an implement to an earth moving vehicle, said implement having a C-shaped hook formed on the rear surface thereof, the apparatus comprising:

a pair of lift arms for lifting the implement;

a pair of tilt rods for effecting tilting motion of the implement;

a pair of lower couplers pivotally connected to said lift arms at one end thereof;

a pair of upper couplers pivotally connected to said tilt rods, said lower and upper couplers being pivotally connected with each other;

an upper connecting beam provided between said pair of upper couplers for connecting the same;

a lower connecting beam provided between said pair of lower couplers for connecting the same, said upper and lower connecting beams being adapted to engage with the C-shaped hook formed on the rear surface of the implement; and lock means for locking said lower couplers relative to said upper couplers thereby preventing pivotal movement with each other said lock means comprising a block having a hole formed therein, said block being fixedly secured to said lower couplers, a lock pin slidably inserted in the hole of said block, and spring means disposed in the hole so as to urge said lock pin towards said upper couplers thereby engaging said lock pin with a hole formed at the lower portion of said upper couplers.

6. An apparatus for attaching an implement to an earth moving vehicle, said implement having a C-shaped hook formed on the rear surface thereof, the apparatus comprising:

a pair of lift arms for lifting the implement;

a pair of tilt rods for effecting tilting motion of the implement;

a pair of lower couplers pivotally connected to said lift arms at one end thereof;

a pair of upper couplers pivotally connected to said tilt rods, said lower and upper couplers being pivotally connected with each other;

an upper connecting beam provided between said pair of upper couplers for connecting the same;

a lower connecting beam provided between said pair of lower couplers for connecting the same, said upper and lower connecting beams being adapated to engage with the C-shaped hook formed on the rear surface of the implement;

lock means for locking said lower couplers relative to said upper couplers thereby preventing pivotal movement with each other; and lock releasing means provided on said lift arms for releasing said lock means thereby allowing said couplers to pivot with each other, said lock releasing means comprising a cylinder fixedly secured to said lift arms, a piston rod having a member fixedly secured to said piston rod at one end thereof, and spring means disposed within said cylinder urging said piston rod to be extended, and a connecting cable for connecting said cylinder to a control lever provided in a driver's cab of the vehicle.

* * * * *